US006183430B1

(12) United States Patent
Lin

(10) Patent No.: US 6,183,430 B1
(45) Date of Patent: Feb. 6, 2001

(54) PORTABLE BATHTUB MASSAGE PAD

(76) Inventor: Ching-Chi Lin, Rm 901, No. 163, Sec 1, Keelung Rd., Taipei (TW)

( * ) Notice: Under 35 U.S.C. 154(b), the term of this patent shall be extended for 0 days.

(21) Appl. No.: 09/392,144

(22) Filed: Sep. 9, 1999

(51) Int. Cl.[7] ..... A61H 7/00; A61H 9/00; A47K 3/00

(52) U.S. Cl. ..... 601/168; 601/155; 601/158; 4/541.1

(58) Field of Search ..... 601/154–160, 601/168, 169, 167; 4/541.1, 541.3, 541.5–541.6, 568–570, 585, 492; 5/900; 239/289; 297/180.1, 180.11, 180.14, 180.15

(56) References Cited

U.S. PATENT DOCUMENTS

| | | | | |
|---|---|---|---|---|
| 2,976,700 | * | 3/1961 | Jackson | 297/180.11 X |
| 3,292,185 | * | 12/1966 | Lucian | 601/168 |
| 3,420,227 | * | 1/1969 | Voorlas | 601/168 |
| 4,151,618 | * | 5/1979 | Carpenter | 4/546 X |
| 4,417,568 | * | 11/1983 | Nozawa et al. | 601/168 |
| 4,765,542 | * | 8/1988 | Carlson | 297/180.15 X |
| 4,780,916 | * | 11/1988 | Sutton | 601/157 |
| 4,854,502 | * | 8/1989 | Cox | 297/180.15 X |
| 4,981,324 | * | 1/1991 | Law | 297/180.11 |
| 5,540,651 | * | 7/1996 | Risch et al. | 601/149 |
| 5,774,907 | * | 7/1998 | Doggweiler | 601/155 |

FOREIGN PATENT DOCUMENTS

3702508 * 8/1987 (DE) .

* cited by examiner

*Primary Examiner*—John Mulcahy
*Assistant Examiner*—Denise Pothier
(74) *Attorney, Agent, or Firm*—Bacon & Thomas, PLLC

(57) ABSTRACT

The invention discloses a portable bathtub massage pad, which can be placed within a bathtub or be hung in a shower room. It comprises a pump, a pad, and a control circuit. The massage effect on human bodies is achieved by the steps of sucking, pumping, and jetting water with the pump to send the pressurized water to the pad that is distributed with water ways inside and jet water on the user via the water outlets on the pad.

5 Claims, 6 Drawing Sheets

PORTABLE BATHTUB MASSAGE PAD

BACKGROUND OF THE INVENTION

1. Field of the Invention

The invention relates to a portable bathtub massage pad and, in particular, to a bathtub massage pad which one can carry around.

2. Description of the Prior Art

Since most of the massage bathtub on the market are of the fixed type. Therefore, if one wants to use a bathtub with the massage function, he or she has to go to the specific places that have such equipment. This is really inconvenient for users who travel frequently.

Furthermore, conventional massage bathtubs are expensive in cost and the only places that can accommodate these sizable bathtubs are the bathrooms of luxurious hotels or entertainment centers. Not every family can afford and own one of those big bathtubs. Thus, for those who like a massage bath, it becomes a very expensive and luxurious enjoyment.

Therefore, the objects in the prior art are not perfect designs and have many disadvantages to await for improvement. In observation of these defects in traditional bathtubs, the inventor made every effort to modify the model and finally succeeded in presenting this portable bathtub massage pad after many years of hard-working and research.

SUMMARY OF THE INVENTION

The present invention provides a portable bathtub massage pad, which is simple in structure, small in volume and easy to store. Thus it can be carried around to fit various types of bathtubs or be directly hung to use.

Furthermore, the invention provides a portable bathtub massage pad, which can greatly lower the cost because of its simple structure and accessible raw material. And its massage function is nevertheless better than usual massage bathtubs, therefore it is extremely good for the mass consumers.

Moreover, the instant invention provides a portable bathtub massage pad, where the water outlets on the pad are distributed according to human acupuncture points. The user can get water-healing effect by the impact of the water jet on the acupuncture points.

Yet, the invention provides a portable bathtub massage pad, whose water outlets can be equipped with switches for the user to turn on or off part of the water outlets at his or her own will.

A portable bathtub massage pad with the above merits according to the invention comprises:

- a pump, which has the functions of sucking, pumping, and jetting water and the strength of which can be adjusted by a control circuit;
- a pad, which is a pad of monocoque; wherein the top end of said pad is covered with a hollowed cylinder for accommodating said pump and the lower part of said pad is an extended long pad fitting to the human height, within which pad are distributed with many incoming water ways and outgoing water ways, and on top surface and along the rim of which are equipped with many water inlets and outlets connecting to the water ways;
- a control circuit, which is placed within the hollowed cylinder and connected to a wired switch via which the user is to control the strength of the pump.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
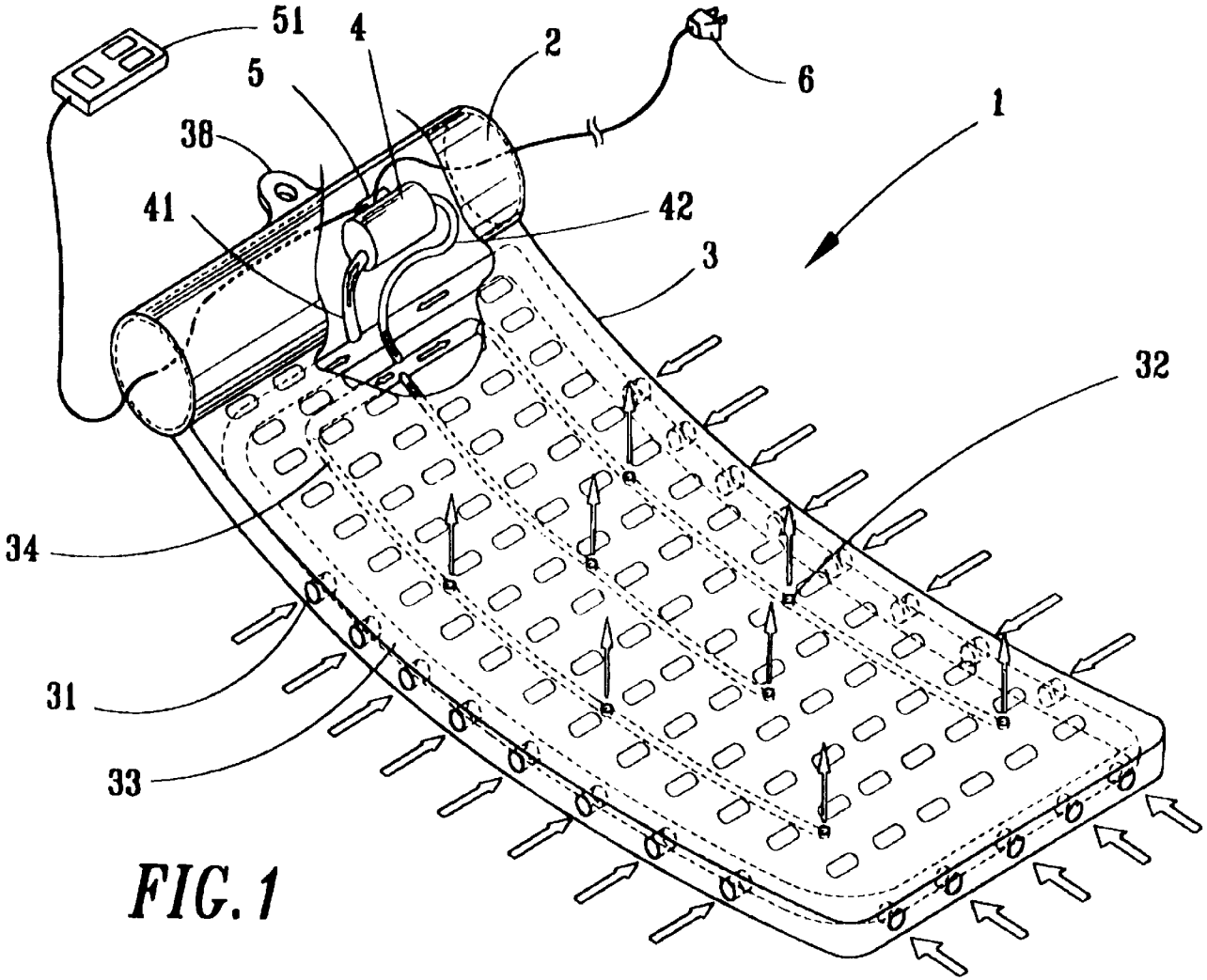
FIG. 1 is a first embodiment of the portable bathtub massage pad according to the invention.

Please refer to FIG. 1, which is a first embodiment of the portable bathtub massage pad according to the invention. From the diagram, one can see that the portable bathtub massage pad 1 according to the instant invention comprises:

- a pump 4, which is placed within a hollowed cylinder 2 and connected to an AC power by a plug 6 to make it function; wherein the working procedure of the pump 4 is first sucking water into the pump 4 via water inlets 31, then pumping the water with the pump 4, and finally jetting out the water via water outlets 32, and the strength of the water jet can be adjusted by a control circuit 5;
- a pad 3, which is a pad of monocoque; wherein the top end of the pad is covered with a hollowed cylinder 2 for accommodating the pump and the lower part of the pad is an extended long pad according to the human height, along the rim of which pad are distributed with many water inlets 31 extending into the pad 3 to incoming water ways 33 that connect to the water intake 41 of the pump 4 while on the top surface of the long pad are distributed with many water outlets 32 extending into the long pad to outgoing water ways 34 that connect to the water exit 42 of the pump 4, so that water enters via the water inlets 31 and the incoming water ways 33 into the pump 4, gets pressurized there, and flows out through the water outlets 32 to complete a whole cycle;
- a control circuit 5, which is placed within the hollowed cylinder 2 and connected to a wired switch 51 via which the user is to control the strength of the pump 4.

The water jet pressurized by the pump 4 to jet out from the water outlets 32 on the pad 3 can provide a good massage effect on human bodies.

Figure 2:
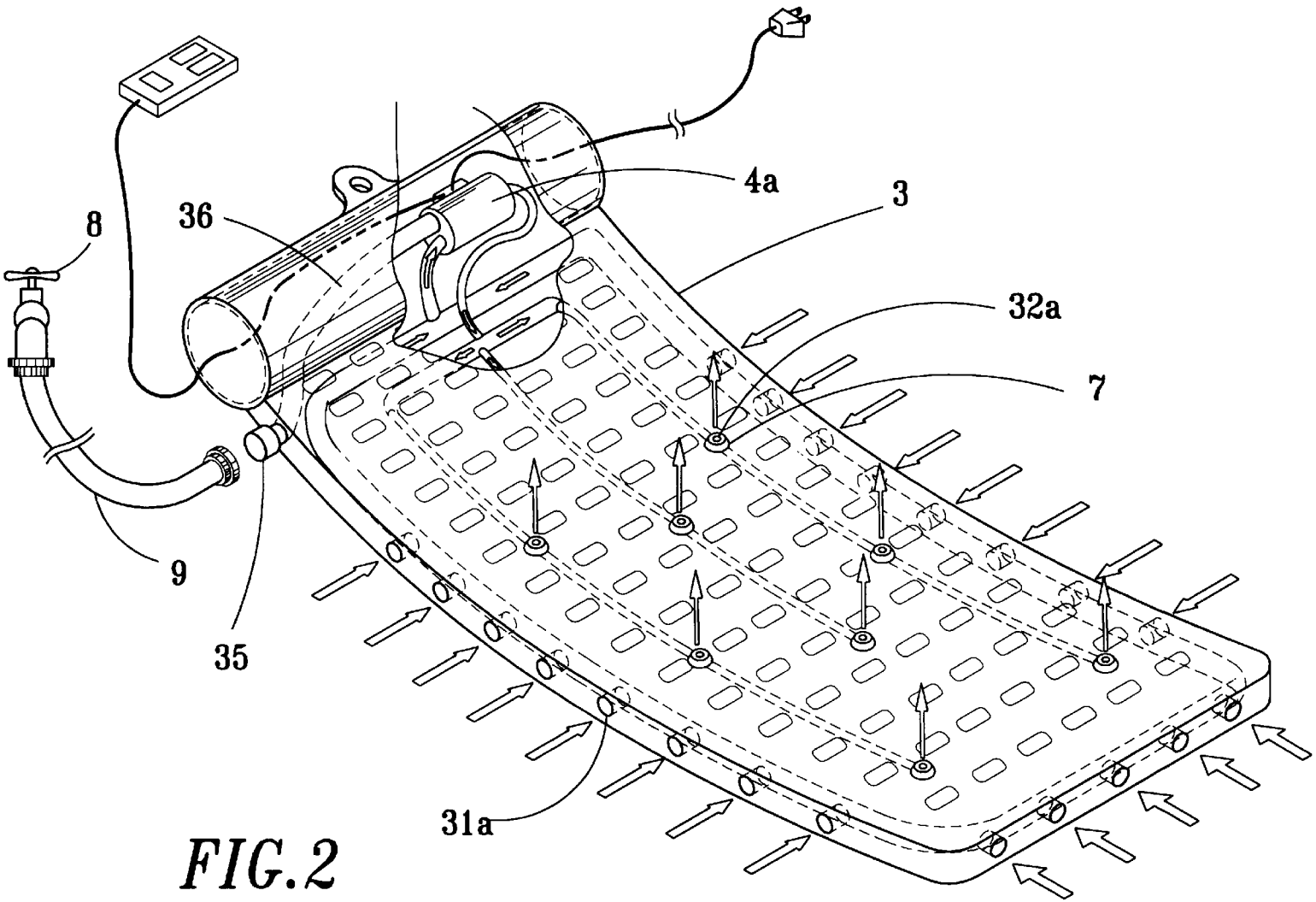
FIG. 2 is a second embodiment of the portable bathtub massage pad according to the invention.

Please refer to FIG. 2, which is a second embodiment of the portable bathtub massage pad according to the invention. The most different point of this embodiment from the first one is that the water outlets 32*a* distributed on the pad 3 are equipped with rotational switches 7. The user can turn the rotational switches 7 to open or close the water output at his or her will. Moreover, in the effect that and the water can not enter from the water inlets 31*a,* the user can connect the water-input hole 35 to the tap 8 by a tube 9. The water is then sent to the pump 4*a* via the water-input hole 35 and a water pipe 36. This configuration can also achieve the same massage effect.

Figure 3A:
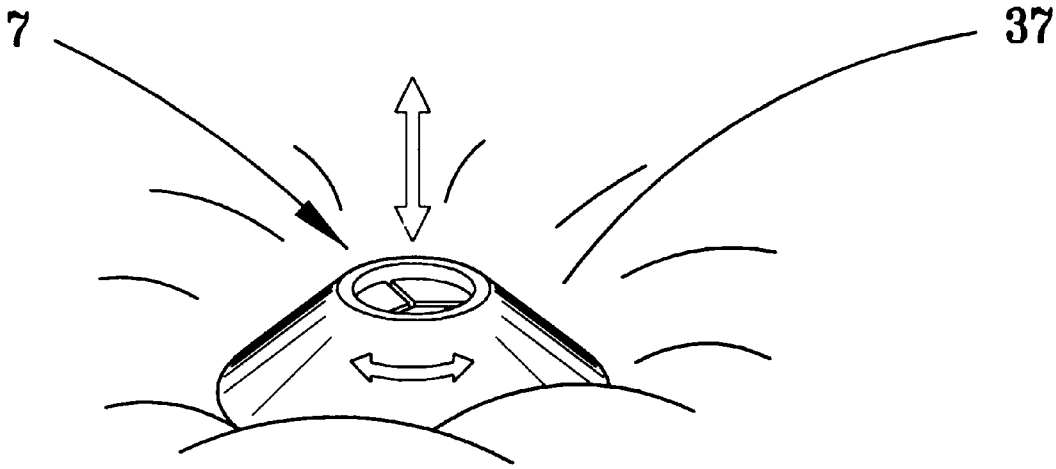
FIG. 3(A) shows the water outlet switch of the portable bathtub massage pad according to the invention.
Figure 3B:
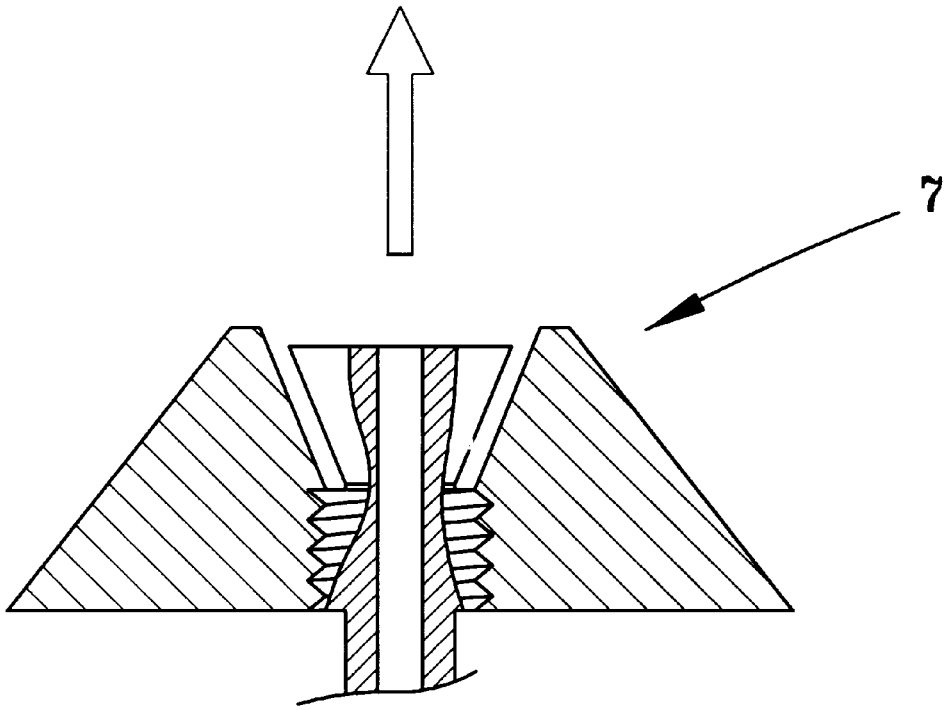
FIG. 3(B) shows the cross section of the water outlet switch of the portable bathtub massage pad according to the invention.

Please refer to FIGS. 3(A) and 3(B), which show the water outlet switch of the portable bathtub massage pad and its cross section according to the invention. The water outlet switch 7 is a conic rotational switch that is placed in the concave part 37 of the pad and allows the user to adjust or even close the water jet by turning the switch.

Figure 4:
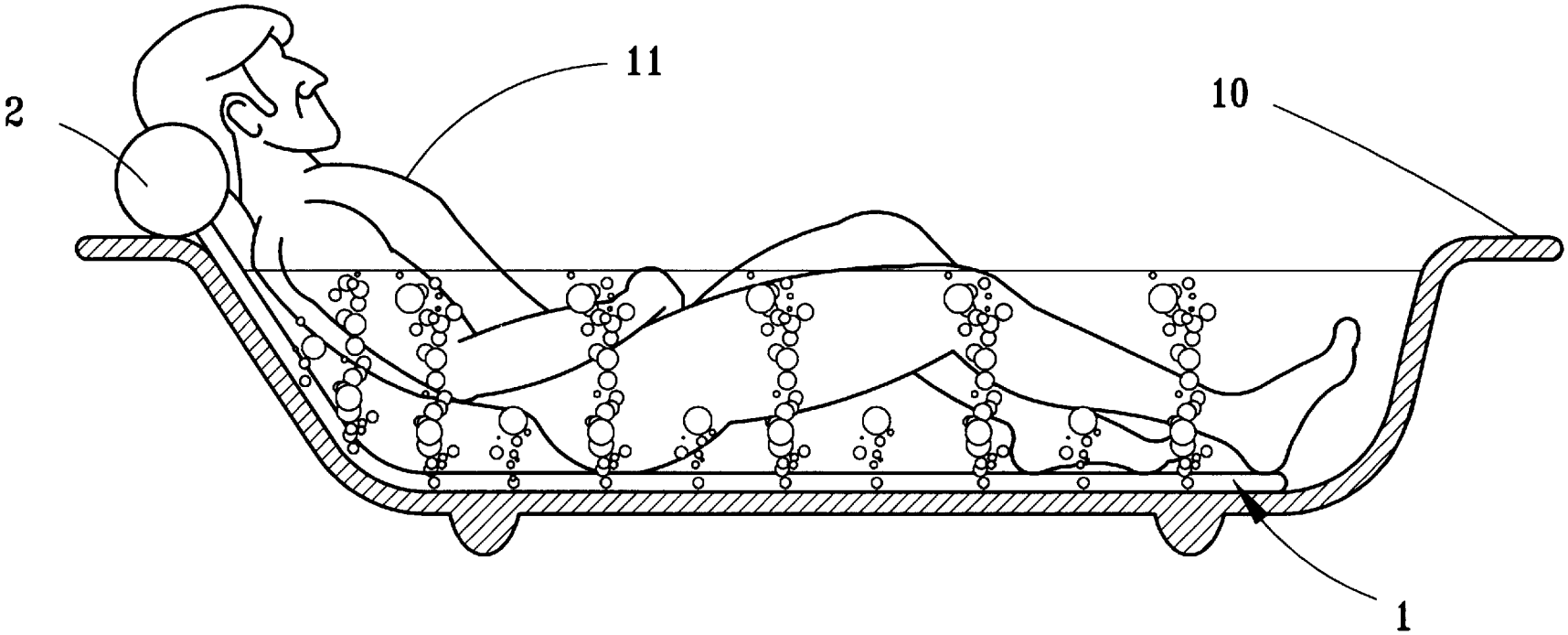
FIG. 4 demonstrates how to use the portable bathtub massage pad according to the invention.

Please refer to FIG. 4, which demonstrates how to use the portable bathtub massage pad according to the invention. When the massage pad 1 of the invention is placed in the bathtub 10, the user 11 can comfortably lie on it, while the hollowed cylinder 2 for accommodating the pump 4 can be used as a pillow. The user can enjoy the massage due to the water jet coming out of the water outlets.

Figure 5:
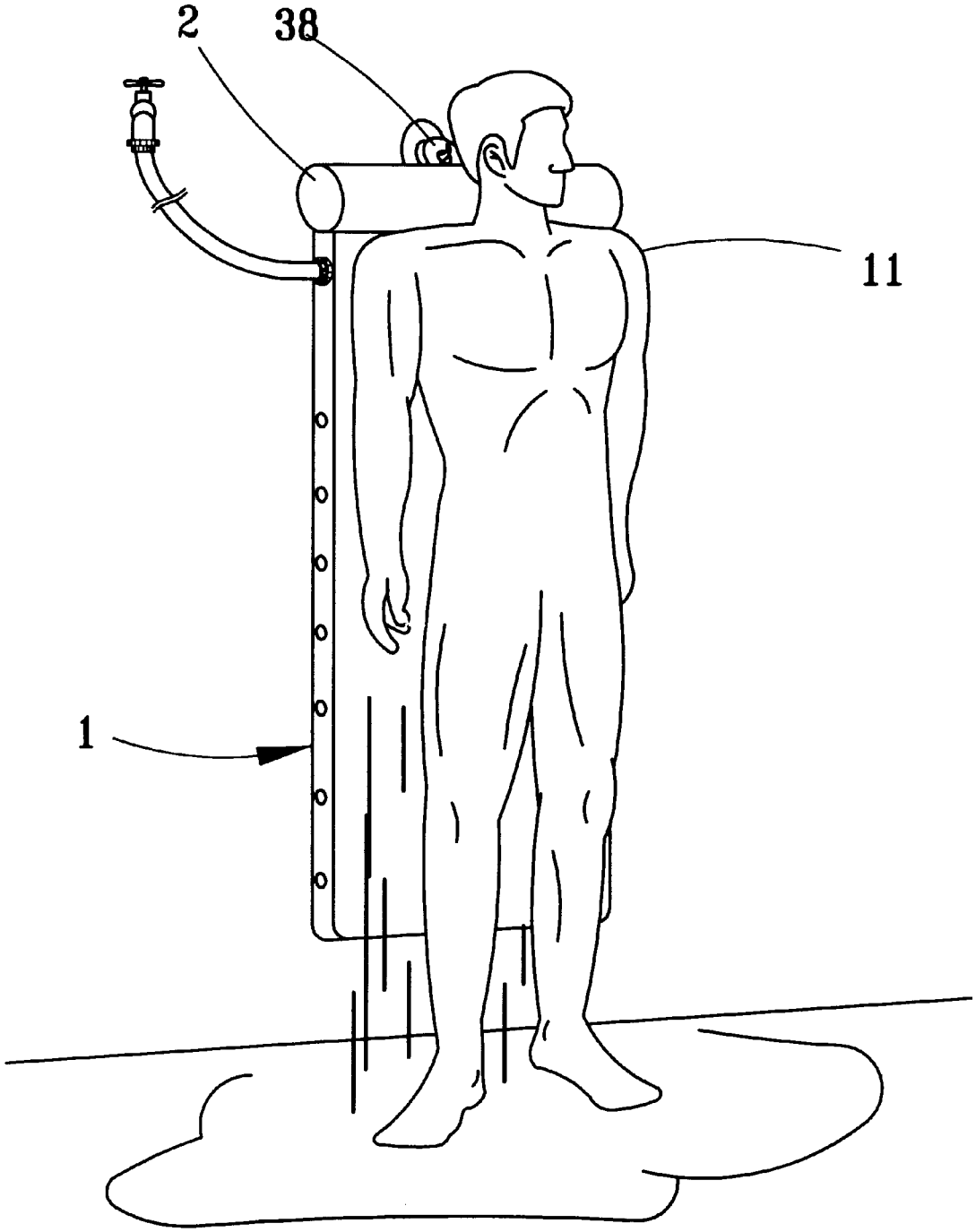
FIG. 5 is a third embodiment of the portable bathtub massage pad according to the invention.

Please refer to FIG. 5, which is a third embodiment of the portable bathtub massage pad according to the invention. The massage pad of the instant invention can be used in the shower room too. By hanging the passage pad 1 with the flying ring 38 above the hollowed cylinder 2 and connecting the water input hole 35 to the tap 8 by a tube 9 for water supply, the water can be pumped to jet out and massage the standing user 11.

Figure 6:
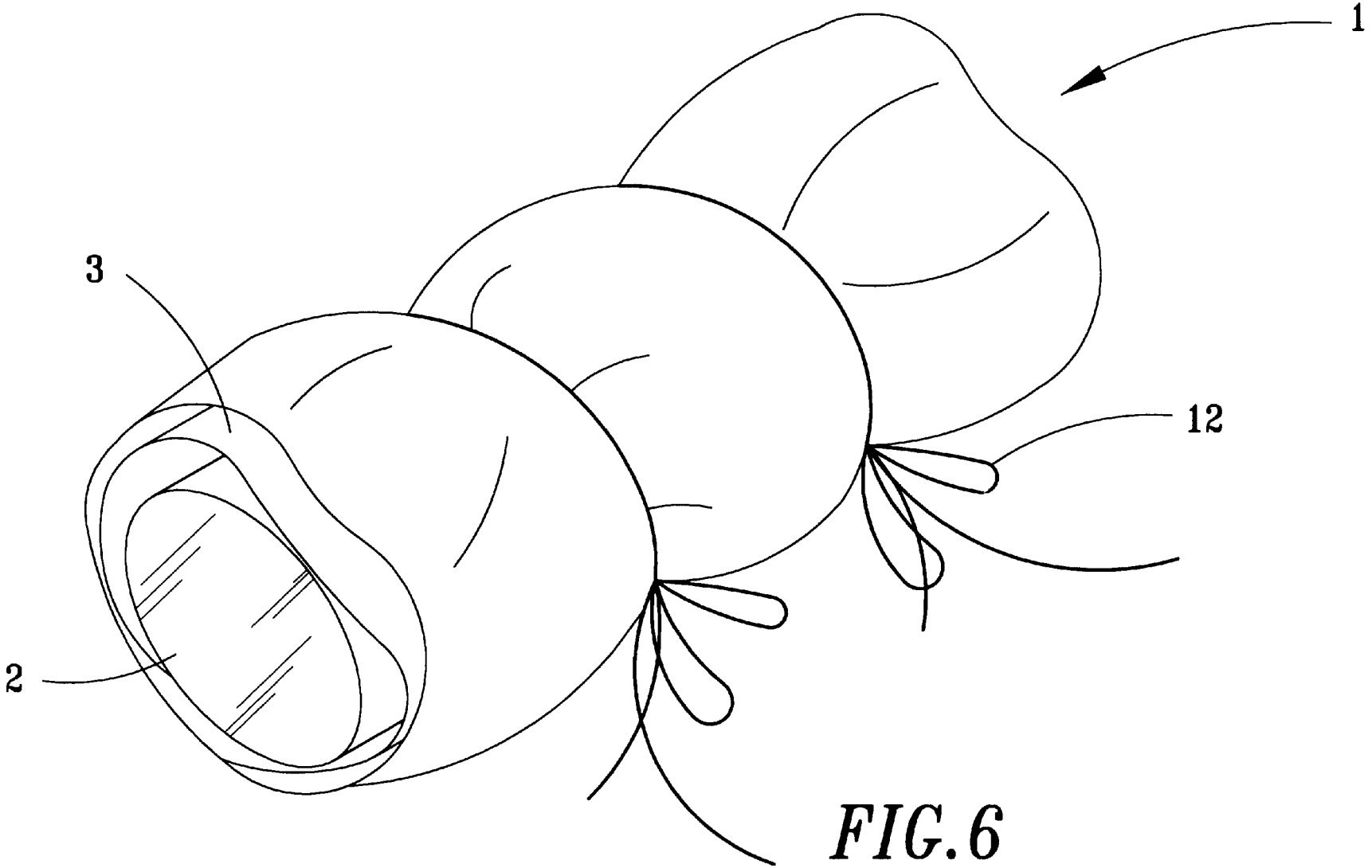
FIG. 6 is a second embodiment of the portable bathtub massage pad according to the invention.

Please refer to FIG. 6, which is a second embodiment of the portable bathtub massage pad according to the invention. After one finishes using the massage pad 1 of the invention, it can be wrapped into a cylinder as a sleeping bag, with the hollowed cylinder 2 placed within and the pad 3 wrapped around. It can be held by a fixing rope 12 to allow the user's carrying.

The portable bathtub massage pad according to the present invention, when compared with other prior arts, has the following advantages:

1. The portable bathtub massage pad according to the invention is simple in structure, small in volume and easy to store, and therefore it is convenient for the user to carry and use.
2. The portable bathtub massage pad according to the invention can fit into any style of bathtub or be directly hung in a shower room.
3. The portable bathtub massage pad according to the invention can greatly lower the cost of manufacturing because of its simple structure and accessible raw material.
4. The portable bathtub massage pad according to the invention has many water outlets distributed on the pad according to the human acupuncture points. The water-healing effect is achieved by the water jet impact on the user's acupuncture points.
5. The portable bathtub massage pad according to the invention can have switches on the water outlets so that the user can adjust to open or close part of the water outlet switches at his or her will.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A portable bathtub massage pad comprising:

a pad of monocoque including a hollowed cylinder and an extended long pad, the hollow cylinder located at a top end portion of the extended long pad, the hollow cylinder contains a pump and control circuit, the extended long pad has a rim and a top surface, the rim having a plurality of water inlets attached to a plurality of incoming water ways located in the extended long pad and the incoming water ways connected to a water intake of the pump and the top surface having a plurality of water outlets attached to a plurality of water outgoing water ways and the outgoing water ways connected to a water exit of the pump, whereby water enters the inlets and the incoming water ways to the pump, is pressurized and jets out the outgoing water ways and outlets, and said control circuit is connected to a wired switch for controlling the pumping strength.

2. A portable bathtub massage pad as defined in claim 1, wherein each of the plurality of water outlets has a rotational switch in a concave part of the pad of monocoque for adjusting the strength of the water jet.

3. A portable bathtub massage pad as defined in claim 1, further comprises a water-input hole connected to the extended long pad and a water pipe, the water pipe is connected to the pump for directly sending water to the pump from a water tap.

4. A portable bathtub massage pad as defined in claim 1, wherein the hollowed cylinder has a flying ring for hanging the portable bathtub massage pad while in use.

5. A portable bathtub massage pad as defined in claim 1, wherein the extended long pad is configured to be wrapped around the hollowed cylinder into a cylinder and includes a rope to fix the pad in the cylindrical shape.

* * * * *